US006050589A

United States Patent [19]

Couderc et al.

[11] Patent Number: 6,050,589

[45] Date of Patent: Apr. 18, 2000

[54] DEVICE FOR RETAINING A BOOT ON A GLIDE BOARD INTENDED FOR SNOWBOARDING

[75] Inventors: Bernard Couderc, Annecy; Jean-Pierre Rigal, La Balme de Sillingy, both of France

[73] Assignee: Salomon S.A., Metz-Tessy, France

[21] Appl. No.: 08/957,790

[22] Filed: Oct. 24, 1997

[30] Foreign Application Priority Data

Oct. 25, 1996 [FR] France ..... 96 13158

[51] Int. Cl.[7] ..... A63C 9/02

[52] U.S. Cl. ..... 280/624; 280/618; 280/14.2

[58] Field of Search ..... 280/14.2, 613, 280/614, 615, 623, 624, 625, 626, 634, 635, 617, 618; 36/117.3

[56] References Cited

U.S. PATENT DOCUMENTS

| | | | |
|---|---|---|---|
| 3,061,325 | 10/1962 | Glass | 280/613 |
| 3,775,875 | 12/1973 | Dvorsky | 36/117.3 |
| 4,021,056 | 5/1977 | Oakes | 280/613 |
| 4,097,062 | 6/1978 | Salomon | 280/618 |
| 4,316,618 | 2/1982 | Sampson | 280/613 |
| 4,973,073 | 11/1990 | Raines et al. | 280/624 |
| 5,299,823 | 4/1994 | Glaser | 280/625 |
| 5,505,477 | 4/1996 | Turner et al. | 280/613 |
| 5,520,406 | 5/1996 | Anderson et al. | 280/624 |
| 5,690,351 | 11/1997 | Karol | 280/14.2 |
| 5,722,680 | 3/1998 | Dodge | 280/14.2 |
| 5,871,226 | 2/1999 | Klubitschko et al. | 280/14.2 |
| 5,957,479 | 9/1999 | Bayer et al. | 280/624 |

FOREIGN PATENT DOCUMENTS

| | | | |
|---|---|---|---|
| 0752258 | 1/1997 | European Pat. Off. . | |
| 2689776 | 10/1993 | France | 280/14.2 |
| 2699828 | 7/1994 | France | 280/14.2 |
| 2902165 | 7/1980 | Germany . | |
| 3601887 | 8/1986 | Germany . | |
| 4311630 | 8/1994 | Germany | 280/14.2 |
| WO 90/11109 | 10/1990 | WIPO . | |
| WO 96/05894 | 2/1996 | WIPO . | |

*Primary Examiner*—J. J. Swann
*Assistant Examiner*—Frank Vanaman
*Attorney, Agent, or Firm*—Greenblum & Bernstein, P.L.C.

[57] ABSTRACT

A retention device for a boot on a glide board intended for snowboarding. The device includes at least one anchoring device and at least one retention member that receives the anchoring device in a housing of the retention member, a latching member cooperating with the retention member in order to maintain the anchoring device in the housing, a support member cooperating with the retention member in order to position the latching member with respect to the housing. The device is wherein a surface of the latching member cooperates, by contact, with a surface of the support member, the surfaces being oriented so as to, on the one hand, be displaced with respect to one another when the latching member is displaced in a latching direction, and on the other hand, retain a fixed position with respect to one another when the latching member is biased in an unlatching direction.

25 Claims, 5 Drawing Sheets

1
9
3
8
26
6
10
25
23
5
14
13
25
29
11
12
25
28
2
8
7
4
8
21
19
8
27
10
25
24
VI
VI

1
VIII
15
16
5
31
10
VII
18
VII
2
20
36
7
23
17
12
3
6
9
19
21
4
11
13
14
VIII 50
2
59
57
60
51
55
56
65
68
58
63
61
64
62
10
7
69
3
9
6
19
4
52
54
53
67
66
70

50
2
59
57
60
65
55
51
56
58
63
61
64
62
10
7
69
3
9
6
19
4
52
54
53
68
67
66
70

DEVICE FOR RETAINING A BOOT ON A GLIDE BOARD INTENDED FOR SNOWBOARDING

BACKGROUND OF THE INVENTION

1. Field of the Invention

The invention is related to a device for retaining a boot on a glide board intended for snowboarding, and is specifically related to an automatic feeding device.

2. Description of Background and Relevant Information

While snowboarding, the user is often called upon to attach and to release his/her boots from the board, for example, in order to use the various mechanical lift means, or to regain his balance after a fall.

The term attaching should be understood as being an operation that consists of affixing a boot to the board, whereas the term releasing denotes the reverse operation.

Various devices have been created in order to facilitate the attaching and releasing operation.

For example, the document WO 96/05994 discloses an automatic attaching device, i.e., a device that enables the user to affix the boot to the board simply by the action of his foot, whereas releasing is done with the help of the hands.

The device according to the document WO 96/05894 includes a boot equipped with two bale assemblies that are designed to cooperate with respective bindings, the bindings having a base affixed to the board. During the attaching operation, one of the bales located on one side of the boot becomes housed in an open notch of the base, whereas the other located on the other side of the boot becomes housed in a notch of the base whose access is controlled by a latch.

When the user presses down with the foot, the bales become immobilized in the notches. During the attaching operation, the latch is displaced from an unlatching position towards a latching position. Once the attaching operation has been undertaken, the latch is maintained in the latching position, for example, via the permanent action of an elastic means, by a mobile hinge mechanism, or even by a catch system.

The boot is thus maintained at a fixed distance from the base on the side of the open notch, and at a variable distance from the base on the side of the latch.

The device according to the document WO 96/05894 does, however, have a certain number of disadvantages.

Firstly, the contact between the boot and the base is variable over time due to the variations in the thickness of the snow or the ice that melts or disintegrates while snowboarding. Consequently, the steering of the board by the user is disturbed.

Secondly, the user cannot perceive all the sensory information with the front and rear ends of the feet. Indeed, until the that the snow or ice melts or disintegrates, the contact between the boot and the base only takes place in a central zone of the boot.

Furthermore, the device does not allow for an easy attaching operation when a very substantial thickness of snow or ice is located between the base and the boot.

SUMMARY OF THE INVENTION

It is an object of the invention to overcome the abovementioned disadvantages.

To the end, the invention proposes a device for retaining a boot on a glide board intended for snowboarding, in which the device includes at least one anchoring device and at least one retention member receiving the anchoring device in a housing of the retention member, a latching member cooperating with the retention member so as to maintain the anchoring device in the housing, a support cooperating with the retention member so as to position the latching member with respect to the housing.

A surface of the latching member cooperates, by contact, with a surface of the support, the surfaces being oriented in such a way as to, on the one hand, become displaced with respect to one another when the latching member is displaced in a latching direction, and on the other hand, retain a fixed position with respect to one another when the latching member is biased in an unlatching direction.

This structure enables the boot to be kept in constant contact with the board over time, independently of the variations in thickness of the snow or the ice that could have gotten housed between the boot and the board. The advantageous result thereof is that the performance of the board is stable over time.

In addition, the contact between the boot and the board occurs over a large surface of the sole of the boot, and this allows the user to perceive all the sensory information that is useful for steering the board.

A positioning mechanism that is affixed to the latching member of the retention device according to the invention includes a retention device and a control means, the retention device retaining the anchoring device in the housing when the anchoring device biases the retention device in an unlatching direction, the control apparatus biasing the latching member towards a latching position when the anchoring device is displaced in the housing towards a latching position, the retention device and the control apparatus being located at a constant distance from one another and on either side of the anchoring device.

Consequently, the forces extended by the use in the direction of the board allow the latching member to be displaced towards the board, especially when the snow or ice melts, and thereafter it is unable to become spaced from it. In this way, the boot always maitains good contact with the board, by the possible intermediary of a layer of snow and/or ice having variable thickness.

The control apparatus limits the displacement of the latching member in the latching direction. This characteristic ought to be considered significant because when the snow has melted completely and the sole of the boot touches the board directly, then the anchoring device is maintained in position in the latching direction only by the positioning mechanism, without touching the base of the housing. The advantageous result thereof is that the control of the position of the anchoring device is precise.

The housing prevents a translation of the anchoring device in any direction with the exception of the latching or unlatching directions, while at the same time the positioning mechanism controls the translation of the anchoring device only in the latching or unlatching directions.

This structure enables the dissociation of the guide arrangement from the anchoring device. The advantage thereof is that the user has substantial freedom of movement for the foot during the attaching operation, and that the immobilization, in translation, of the anchoring device is complete in all directions after attaching.

The latching member according to the invention is rotationally removable about an axis, and in that the support arrangement is rotationally movable about an axis that is different from the rotational axis of the latching member.

The difference in the location of the axes allows the creation of a wedging effect between the latching member and the support arrangement. The two axes and the contact zone, obtained by the surfaces of the latching member and the support means, constitute the three peaks of a triangle deformable in the same manner, in light of the orientation of the surfaces. Consequently, the functions of the device according to the invention are achieved in a very simple manner.

In addition, the rotationally movable elements are less apt to get blocked due to a freeze, when compared to those mechanisms or elements that are mobile in translation.

Further according to the invention, the rotational axis of the support arrangement is located on the retention member, substantially between the housing and the rotational axis of the latching member. As such, the kinematics of the device are exceedingly simple.

Furthermore, the space requirement of the device is reduced in a direction that is spaced with respect to the board, since the housing and the rotational axes are close to the board.

According to a variation, the rotational axis of the support arrangement and the rotational axis of the latching member are located on the retention member such that each of them is close to the boot when the device retains the boot on the board, the rotational axis of the latching member being closer to the board than the rotational axis of the support arrangement.

In this case as well, the kinematics of the device remain very simple, whereas the space requirement for the device is reduced in the direction of its spacing from the boot, because the housing and the rotational axes are close to the boot.

Still further according to the invention, an elastic device permanently biases the latching member and the support arrangement with respect to one another, in such a direction that the surface of the latching member is in contact with the surface of the support arrangement when the latching member is in a latching position.

In this way, the latching of the device is guaranteed in the absence of any manual unlatching bias.

Still further according to the invention, a stop mechanism maintains the latching member and the support arrangement in a fixed position with respect to one another when the latching member is in an unlatching position. As a result, the use carry out the feeding operation without using his hands.

Finally, according to the invention, the anchoring device of the boot is located on one side of the boot.

Consequently, the feeding operation is easy, regardless of the thickness of the snow or ice, because the user's foot has a greater freedom of movement.

BRIEF DESCRIPTION OF THE DRAWINGS

Other characteristics and advantages of the invention will be better understood in light of the following description, with reference to the annexed drawings that illustrate, as non-restrictive examples, how the invention can be obtained and wherein.

DETAILED DESCRIPTION OF THE PREFERRED EMBODIMENTS

Figure 1:
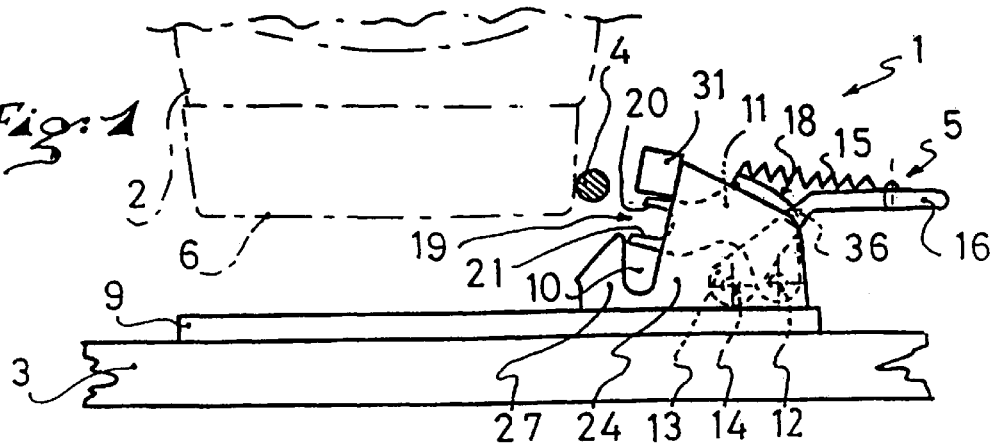
FIG. 1 is a diagram showing a boot before the latching operation on a retention member in the unlatching position, according to a first embodiment of the device.

A first embodiment of the invention will now be described with the aid of FIGS. 1 through 8.

FIGS. 1 through 4 are schematic views of a retention device 1 of a boot 2 on a glide board 3. In these drawings, the boot 2 is resented in dotted and dashed lines and is shown in a direction that can either be a rear view or a front view.

On the one hand, the device 1 comprises an anchoring member 4 affixed to the boot 2, and on the other hand, it comprises a retention mechanism or member 5 for the anchoring device 4 affixed to the board 3.

In a complementary manner, although this is not a requirement, a base 9 is provided to be interposed between device 1 and board 3, the base 9 being capable, for example, of spacing the device 1 from board 3, or of adjusting the position of boot 2 with respect to board 3. Base 9 is affixed to board 3 by any known means such as a screw/nut assembly.

The anchoring member 4, represented in the form of a metallic wire or rod, is positioned laterally with respect to the boot 2, and is in proximity to the sole 6 of boot 2. Wire 4 is located substantially mid-way between a non-represented rear end and front end of boot 2, and extends partially in a direction that is substantially parallel to sole 6.

Figure 5:
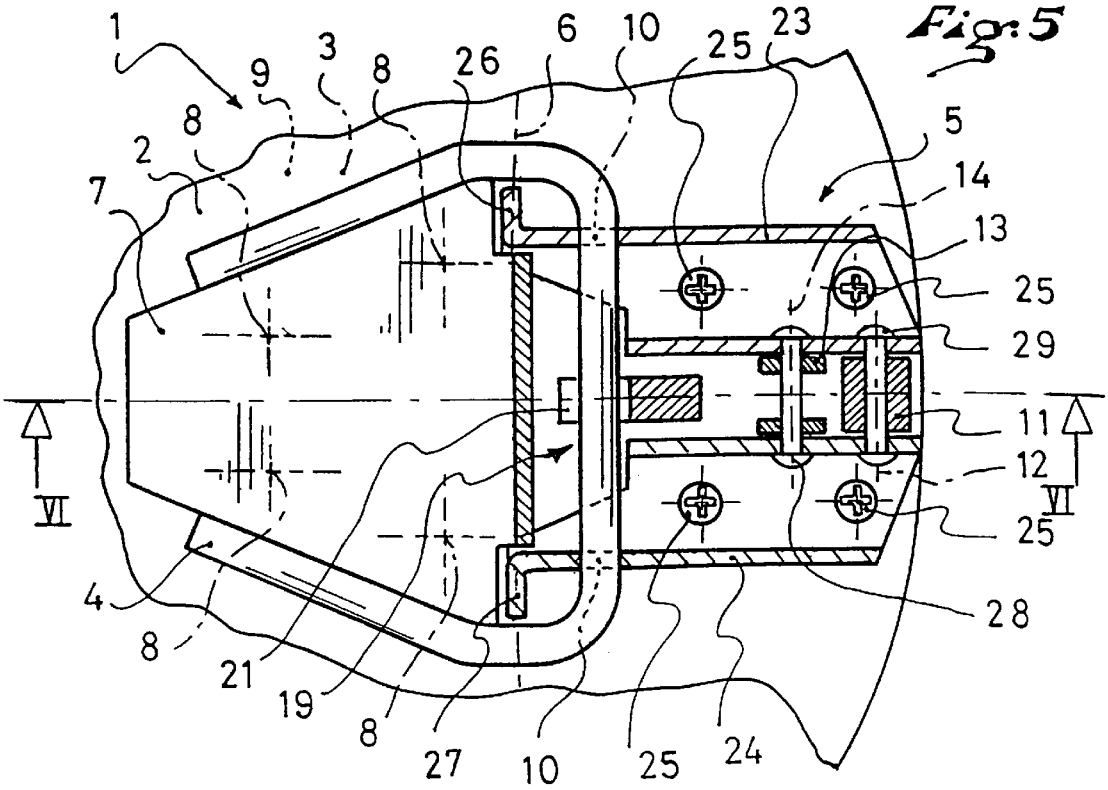
FIG. 5 is a section along line V—V of FIG. 4.

A means for affixing wire 4 to boot 2 is visible, for example, in FIG. 5. Wire 4 is shaped like a hook whose ends are connected to a plate 7 by any means such as a weld. Plate 7 is affixed to the sole 6 of boot 2, for example, via rivets, symbolized by four axis lines 8. Preferably, plate 7 is fixed beneath the boot 2 in a non-represented recess of sole 6, the recess being located in the usual manner between the rear end and the front end of boot 2.

Figure 6:
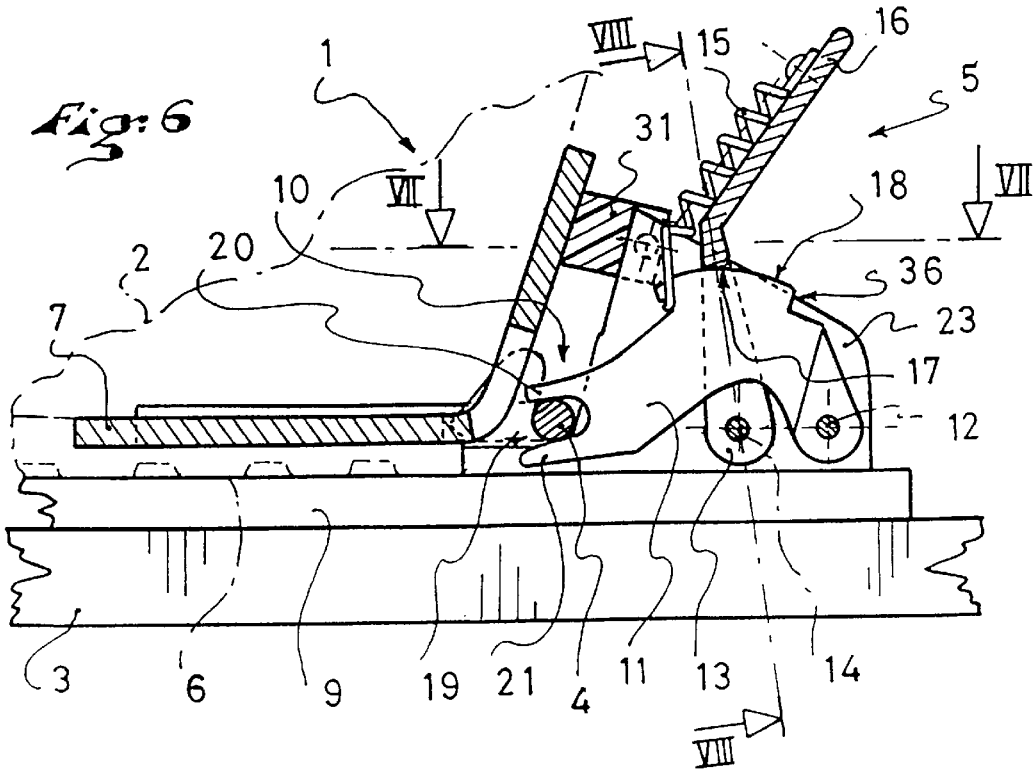
FIG. 6 is a section along line VI—VI of FIG. 5.

The wire 4 is capable of cooperating with the retention member 5, as bas been shown, for example, in a lateral section in FIG. 6, in which the device 1 is found to be in a latching position. Sole 6 is in contact with base 9, the wire 4 being maintained in the latching position with respect to board 3 by the retention member 5. Wire 4 is housed in a notch or opening 10 of the retention member 5, and kept in such notch or opening 10 by a latching member 11 represented in the form of a latch journaled about an axis 12 of the retention member 5. Latch 11 is immobilized by a support means 13 represented in the form of a lever journaled about an axis 14 of the retention member 5.

Wire 4 is maintained in position as follows. The journal axis 14 of lever 13 is located substantially between the wire 4 and the journal axis 12 of latch 11. An elastic device 15, represented in the form of a spring, permanently biases latch 11 and lever 13 with respect to one another so that they tend to rotate in opposite directions with respect to one another about their respective axes 12, 14. As a matter of fact, one end of spring 15 is affixed to a bar 16 of lever 13, whereas the other end of spring 15 is affixed to latch 11, by means that have been successively represented by a rivet on bar 16 and becoming engaged in a recess of latch 11.

Lever 13 and latch 11 are in support against one another by a surface 17 of lever 13 and a surface 8 of latch 11.

Furthermore, latch 11 cooperates with the wire 4 by means of a positioning member or fork 19 comprising a retention element arm or means 20, and a control element, arm or means 21. When a force exerted on wire 4 by boot 2 biases latch 11 by means of retention arm 20 in a direction wherein wire 4 comes out of opening 10, the latch 11 remains immobile because the engagement surfaces 17 of lever 13 and 18 of latch 11 are oriented in such a direction as to prevent any movement of latch 11 in such circumstances.

In other words, this means that a user cannot release the boots as a result of the forces that are caused by snowboarding.

The various component elements of the retention member 5 are positioned with respect to one another in the manner explained below with respect to FIGS. 5, 6, 7, and 8.

FIG. 5 is a cross section that passes substantially through the axes 12 and 14 of latch 11 and lever 13, as well as through wire 4. The retention member 5 comprises two symmetrical sections 23, 24 that are affixed to the base by affixing means represented in the form of screws 25. The sections 23, 24, obtained for example from pressed and folded steel, define the abutments 26, 27 for controlling the position of boot 2 in its lengthwise direction.

Journals, represented in the form of a rivet 28 extending along the 14, and a rivet 29 extending along the axis 12, respectively allow the lever 13 and latch 11 to pivot in a plane that is substantially perpendicular to board 3, such plane beings located between the sections 23 and 24 of the retention member 5.

Figure 8:
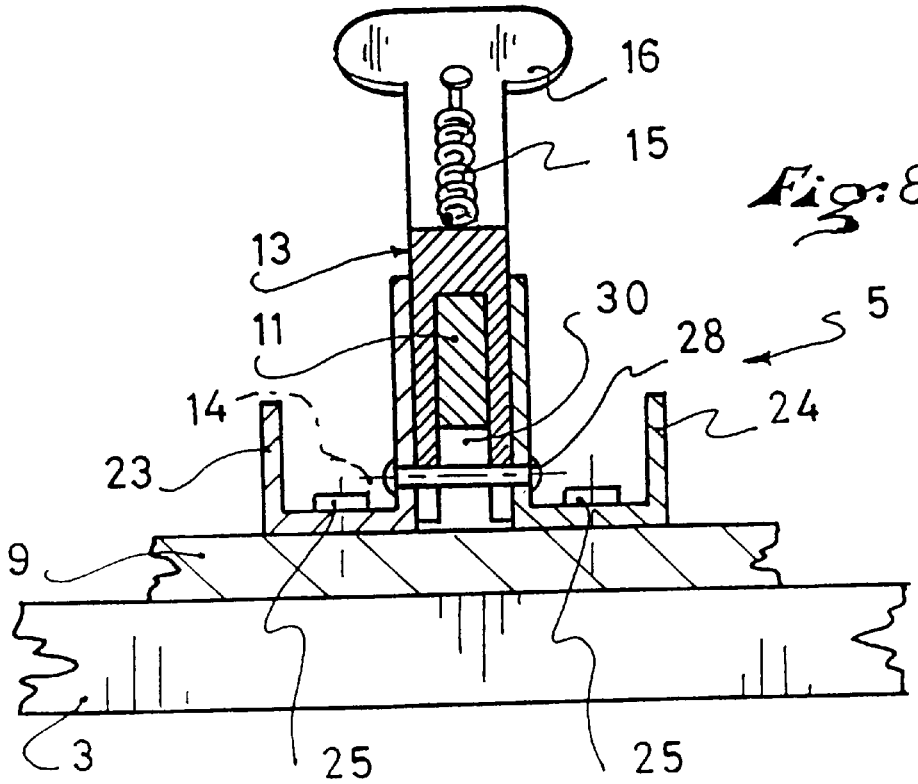
FIG. 8 is a section along line VIII—VIII of FIG. 6.

As will be better understood from the drawing of FIG. 8, latch 11 can pivot about its axis 12 through a opening 30 of lever 13.

As shown in FIGS. 1, 2, 3, 4, and 6, boot 2 is retained on the board 3 by a single wire 4 located in a lateral position along the boot 2.

Figure 7:
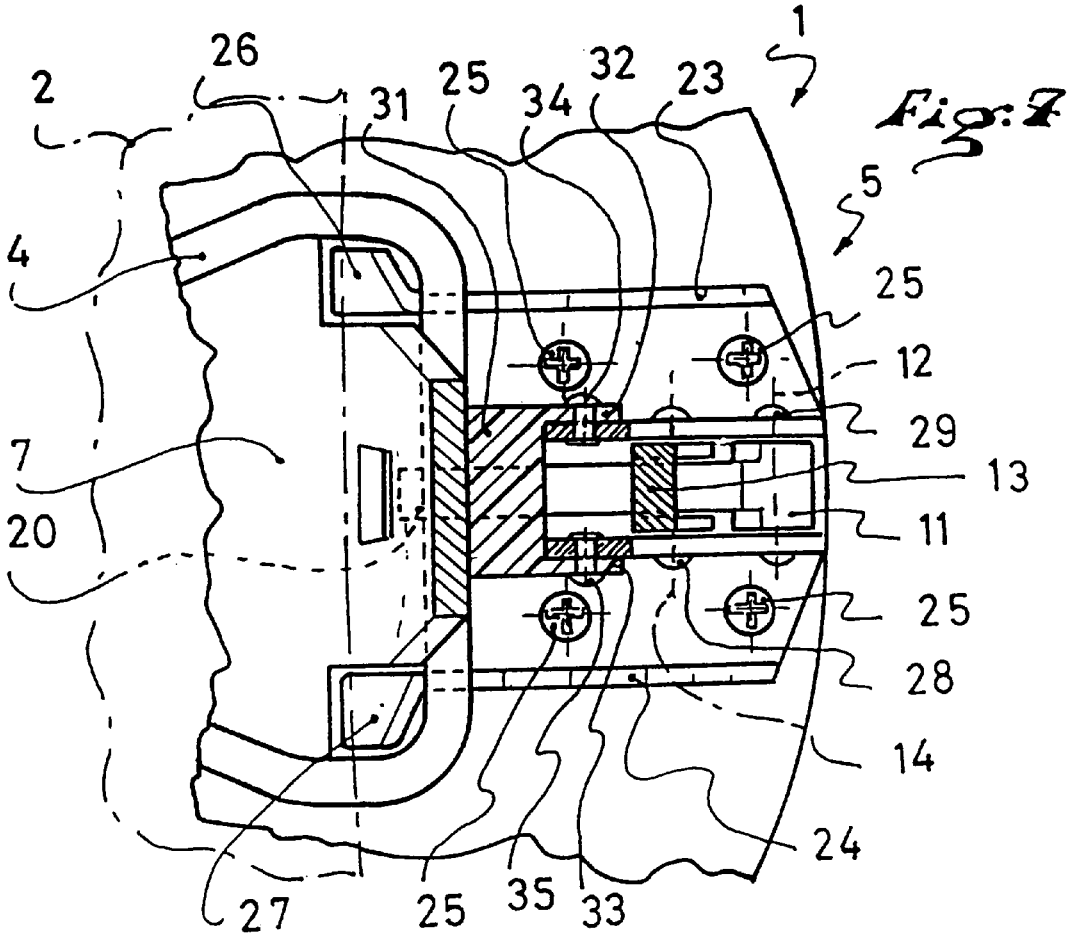
FIG. 7 is a section along line VII—VII of FIG. 6.

Preferably, a support 31, visible in FIGS. 1, 2, 3, 4, 6 and 7, ensures the management of the position of boot 2 with respect to board 2, in a rational direction with respect to wire 4. This support 31, clearly visible for example in FIG. 7, is a support member comprising two extensions 32, 33 that are affixed on the sections 23, 24, by means of rivets 34, 35, for example.

The support member 31 can be made of a relatively rigid material so as to prevent or substantially limit the rotation of boot 2 about wire 4 with respect to board 3. In this case, a rubber or a flexible plastic material would be appropriate.

The support member 31 can also be made from a relatively flexible material so as to tolerate the rotation of boot 2 about wire 4 with respect to the board 3. In this case, a rubber or a flexible plastic material would be appropriate.

The device 1 according to the invention operates as follows. The user can place the retention member 5 in the open position shown in FIG. 1 by manually biasing the lever 13. He needs only to press bar 16 in order to make the lever 13 pivot about the axis 14 in the direction wherein bar 16 is moved towards the board 3. This operation is undertaken against the action of the spring 15. When the lever 13 pivots and when the wire 4 does not retain the latch 11 in the latching position of FIG. 6 by acting on the control arm 21, then latch 11 pivots in the same direction as lever 13 until the open position is attained.

The open position is stable because the lever 13 cooperates with a stop means 36, represented in the form of a recess on shoulder that partially demarcates the surface 18 of latch 11.

In the open position of the device, spring 15 is in a substantially maximum state of tension; the bar 16 of lever 13 is maintained in contact with the recess 36; and the fork 19 is in an open position, or in other words, in the position that is furthest from board 3.

The user can thus approach the boot for the attaching operation.

The attaching operation includes positioning boot 2 with respect to the retention member 5 in such a way that the wire 4 enters into the fork 19 above the opening 10, and then pressing the boot towards board 3 with the foot, no other manual action being necessary. The support of the foot causes the wire 4 to enter into opening 10, and is in turn causes a rotation of latch 11 by acting on the control arm 21 of latch 11. The rotation of latch 11 causes the rotation of leer 13 by virtue of the tension of spring 15.

When the wire 4 is sufficiently low in opening 10, the bar 16 of lever 13 comes out of the recess 36 of latch 11 and the surface 17 of lever 13 comes into contact with the surface 18 of latch 11. At this moment, the device 1 is in a latching position.

The shapes of surface 17 and 18 enable the gradual, on progressive, adjustment of the position of wire 4 in opening 10. The surface 18 of the latch 11 has a substantially smooth surface, it being shown as having a substantially constant arc of curvature. The device 1 enables the limitations linked to the presence of wedges of snow and/or ice to be overcome.

Figure 2:
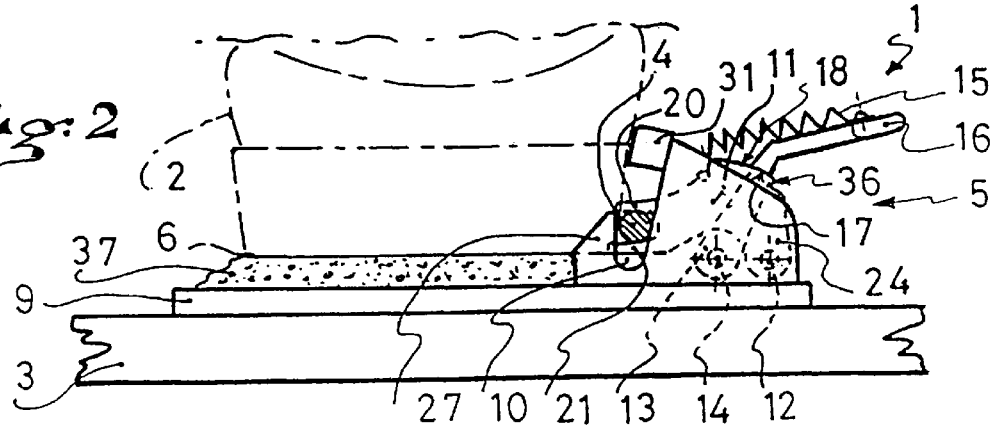
FIG. 2 is a diagram of the retention device in a high latching position.

FIG. 2 is an example of a latching position of device 1 in the presence of a thick wedge of snow 37. The device 1 is latched because the latch 11 and lever 13 are in contact via their respective surfaces 18 and 17. The fork 19 of latch 11 is in the high latching position. Wire 4, and consequently, boot 2, are retained on board 3.

Figure 3:
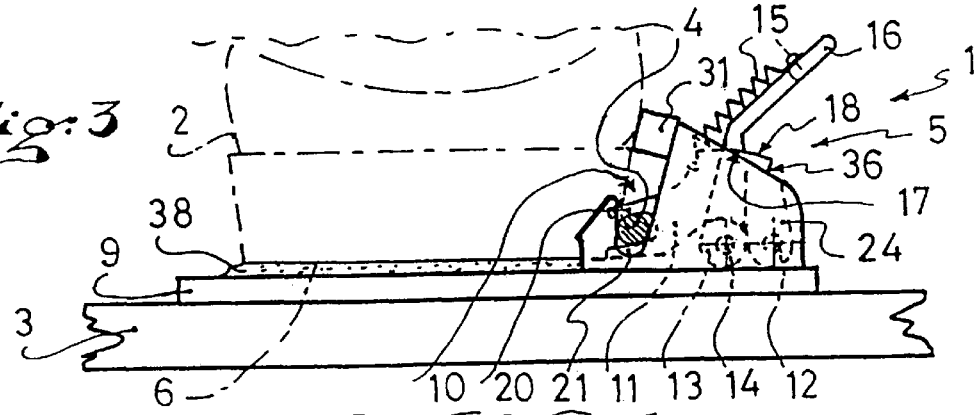
FIG. 3 is similar to FIG. 2 but it corresponds to an intermediate latching position.

FIG. 3 corresponds to a latching position of device 1 in the presence of a thin wedge of snow 38. The sole 6 is closer to board 3 and the bar 16 of lever 13 is further away from board 3 than is the case in FIG. 2.

Figure 4:
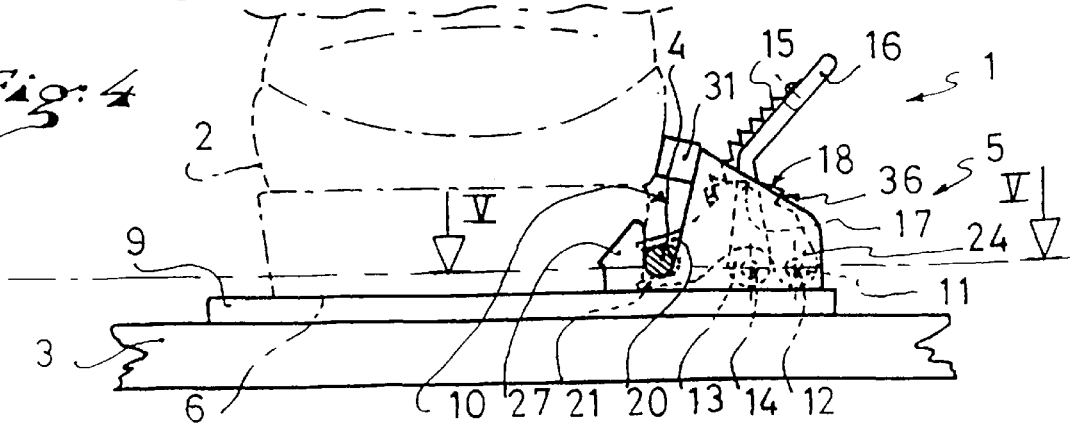
FIG. 4 is similar to FIGS. 2 and 3 but it corresponds to a low latching position.

Finally, FIG. 4 corresponds to a latching position of device 1 when all the snow has melted. Sole 6 takes support directly on base 9, the bar 16 of lever 13 is in its furthest position from board 3, and the fork 19 is in its latching position that is closest to board 3.

FIGS. 1 through 4 have enabled the functioning of device 1 to be understood. Boot 2 can be displaced towards board 3 as and when the wedge of snow melts or disintegrates, but it cannot be raised up unless the user undertakes a manual unlatching operation. Because the boot is constantly retained firmly in place in the range of latching positions shown, e.g., in FIGS. 2 through 4, unlike a retention device that is simply movable between one open and one retention position, the retention device of the invention can be termed "progressive".

Consequently, the user advantageously retains a permanent and homogeneous support of sole 6 on board 3, independently of the variations in thickness of the intermediate portion constituted by a wedge of snow or ice 37, 38.

Figure 9:
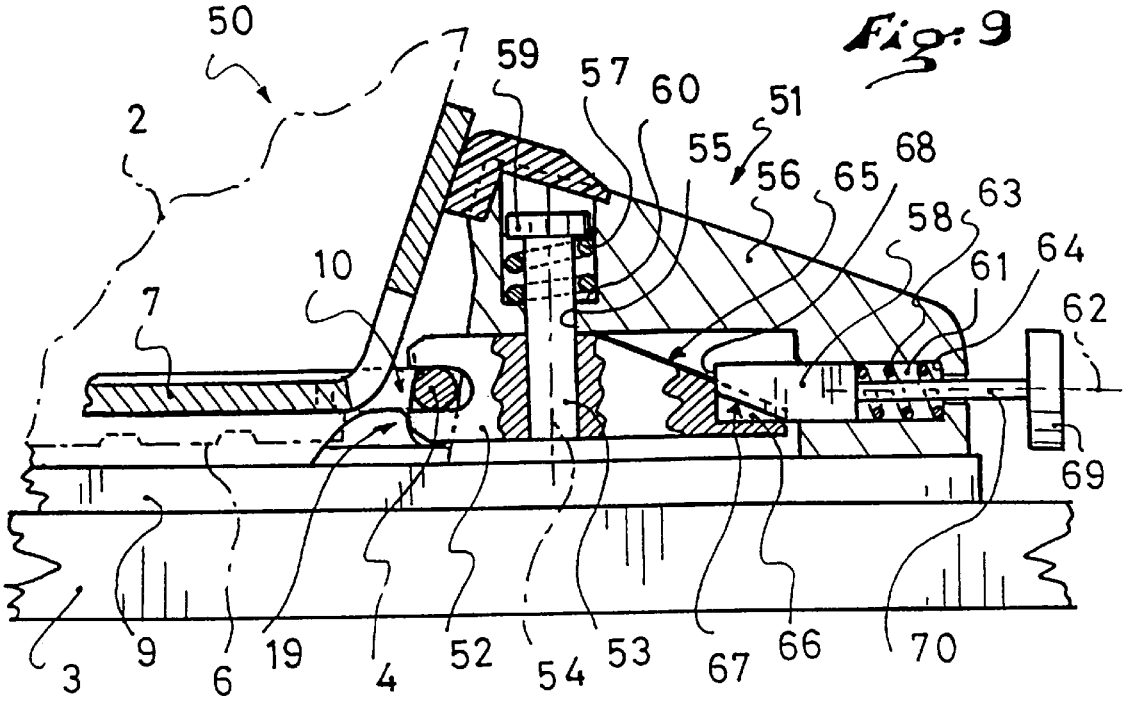
FIG. 9 is a sectional view of the device in an unlatching position according to a second embodiment.
Figure 10:
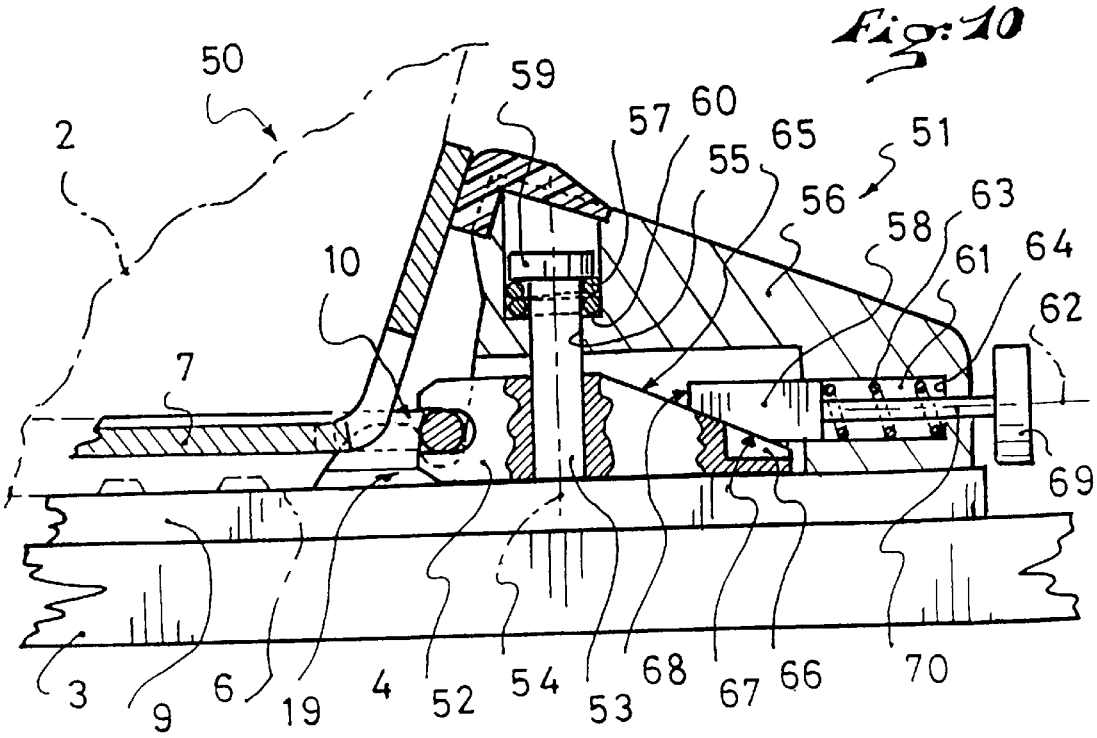
FIG. 10 is similar to FIG. 9 but it corresponds to latching position.

A second embodiment of the invention is represented by means of FIGS. 9 and 10. For the sake of convenience, the same elements have been designated by the same A retention device 50 for boot 2 on board 3 comprises, on the one hand, a wire 4, and on the other hand, a retention member 51. As was the case in the first embodiment, base 9 can be interposed between the devices 50 and board 3.

The retention member 51 comprises a latch 52 that is borne by a shaft 53 of axis 54. The shaft 53 is guided in translation by a bore 55 of a chassis 56 of the retention member 51. The orientation of axis 54 enables shaft 53 and latch 52 to be displaced along a direction that is substantially perpendicular to board 3, by cooperating, on the one hand with a spring 57, and on the other hand, with a support means 58 represented in the shape of a wedge.

Spring 57 permanently biases shaft 53 in a direction that is away from board 3 by taking support on a shoulder 59 of shaft 53 and on the base 60 of bore 55.

Wedge 58 is translationally mobile in a bore 61 of axis 62 of chassis 56, in a direction that is substantially perpendicular to the axis 54 of shaft 53. A spring 63 permanently biases wedge 58 in a direction that brings it closer to latch 52 by taking support on the wedge 58 and on the base 64 of bore 61.

Latch 52 and wedge 58 have complementary profiles. Latch 52 comprises a substantially rectilinear surface 65 that is inclined with respect to axis 54 of shaft 53, the surface 65 being demarcated by a recess 66 at one end of latch 52 that is opposite the end comprising the fork 19 adapted to receive the wire 4. The wedge 59 has a lower inclined surface 67 that is substantially parallel to the face 65 of the latch 52, the surface 67 sectioning one end 68 of wedge 58.

The device 50 functions as follows.

Firstly, the user can place the retention member 51 in the open position as shown in FIG. 9.

To this end, he is only required to compress spring 63 by pulling on a knob 69 that distances wedge 58 from the slit 10 of the retention member 51 by means of a bar 70. In the absence of any retention of latch 52 by the action of wire 4 in fork 19, the latch 52 becomes spaced from board 3 until the end 68 of wedge 58 gets housed in the recess 36 of latch 52. At this moment, the retention member 51 is in a stable open position.

For the attaching operation, the use can thus bring boot 2 close to the device 50 in such a way that the wire 4 enters into fork 19 of latch 52 above the slit 10.

An attaching position is represented in FIG. 10 in which a wedge of snow has melted completely. The user has pushed towards the board 3 with his foot. Latch 52 is in a low position and the wedge 58 has come closer to wire 4 under the action of spring 63. Thereafter, latch 52 and wedge 58 are in contact by their respective inclined surfaces 65 and 67 because by becoming displaced, latch 52 has allowed the end 68 of wedge 58 to come out of the recess 66 of latch 52.

Boot 2 is retained because the wire 4 is repined in the slit 10 by the fork 19 of latch 52, due to the inclination of the surfaces 65 and 67 and due to the friction coefficient of one surface on another.

The surfaces 65 and 67 of latch 52 and wedge 58 constitute an irreversible system. The wedge 58 can slide gradually towards wire 4 under the action of spring 63 when the latch 52 approaches the board 3, but the inverse phenomenon cannot occur.

Consequently, the device a according to the second embodiment of the invention fulfills the same functions as for the first embodiment.

Figure 11:
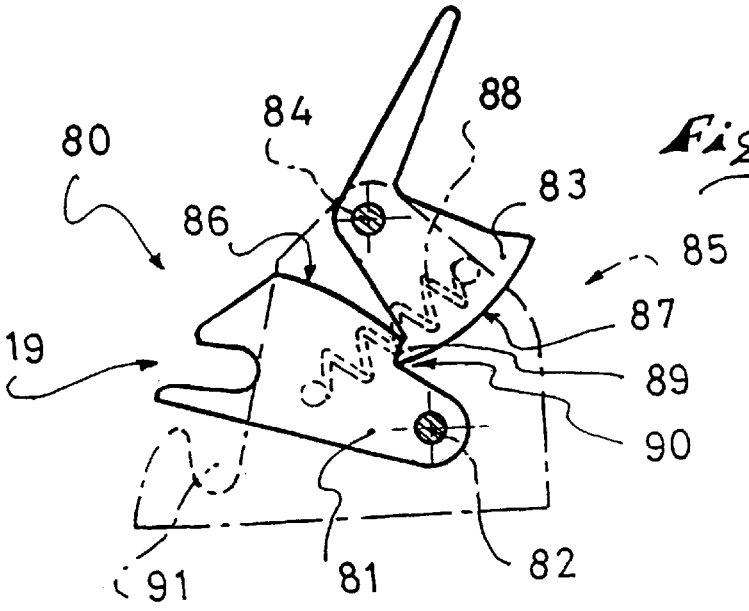
FIG. 11 is a sectional view of the device in an unlatching position according to a third embodiment.
Figure 12:
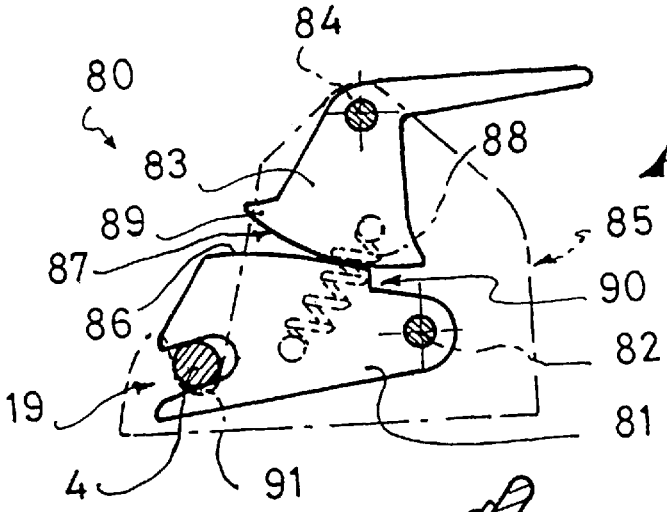
FIG. 12 is similar to FIG. 11 but it corresponds to a latching position.

A third embodiment of the invention is represented schematically in FIGS. 11 and 12. For the sake of convenience, the same elements have been designated by the same references.

A retention device 80 comprises a latch 81 journaled about an axis 82, and a support member 83 journaled about an axis 84 on a common part of a retention member 85. The latch 81 comprises a fork 19 that is designed to cooperate with the wire 4 of the boot 2, and a surface 86 is designed to cooperate with a surface 87 of the support means 83. A spring 88 permanently biases the latch 81 and the support member 83 towards one another, one end of the spring 88 being affixed to latch 81, whereas the other end is affixed to the support member 83.

FIG. 11 represents the device 80 in an open position. One end 89 of the surface 87 of the support means 83 is in support in a recess 90 of latch 81.

The spring 88 is substantially extended. The user can undertake the attaching operation in a manner that is similar to the operation described previously, and bring the device 80 into a latching position as shown in FIG. 12.

The wire 4 is retained in a slit 91 of the retention member 85, the end 89 of surface 87 of the support member 83 has come out of the recess 90 of latch 81, and the surfaces 86 of latch 81 and 87 of the support member 83 are in contact.

The third embodiment of the device according to the invention fulfills the same functions as the previous embodiments.

The invention is not limited to the particular embodiments described herein, and can comprise all technical equivalents within the scope of the claims that follow.

The first and third embodiments have combined the rotational movements of latch 11, 81 and of lever 13, 83. The second embodiment has combined the translational movements of latch 52 and wedge 58.

It is possible to envision other devices combining the rotational or translational movements of the elements used to immobilize wire 4 in opening 10.

Furthermore, the various elements could also be configured differently. For example, the anchoring device 4 could have a non-circular shape, the axes of latch 11 and lever 13 could be arranged otherwise on the retention member 5, and the elastic means could have a different structure.

In addition, several anchoring devices 4 could be provided on the same side of boot 2 and these could be respectively associated to several retention members 5, 51.

One can also envision various qualities for the contact surfaces between the latch 11, 52, 81 and the support means 13, 58, 83.

In the examples represented in FIGS. 1 through 12, these contact surfaces are substantially smooth and continuous.

Figure 13:
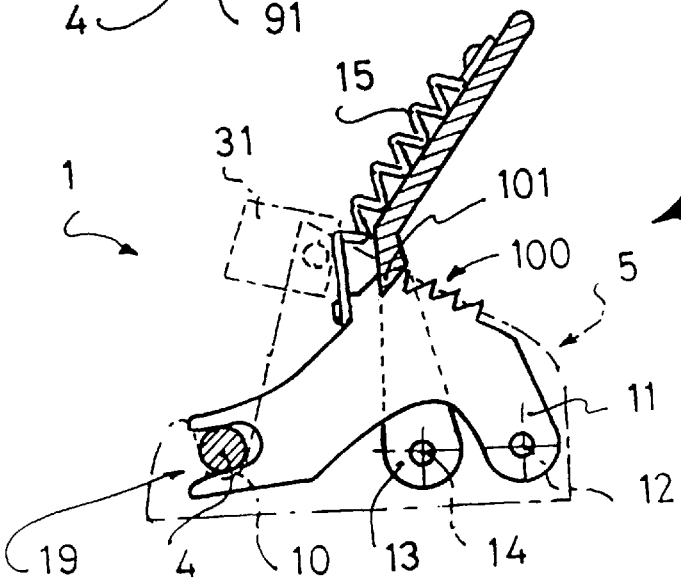
FIG. 13 is a specific example of the cooperation between the latching member and the support arrangement as applied to the first embodiment.

FIG. 13 shows that it is possible to have broke contract surfaces. For example, in the first embodiment, a rack 100 on latch 11 cooperates with a serration 101 of lever 13.

What is claimed is:

1. A retention device for a boot on a gliding board, said retention device comprising:

an anchoring member adapted to be secured to the boot and to extend laterally from only one side of the boot, the retention device including no anchoring member extending from an opposite side of the boot;

a retention mechanism adapted to be affixed to the gliding board, said retention mechanism comprising a housing having a size and shape to receive said anchoring member in a latching position of the retention device;

said retention mechanism further comprising:

a latch including a portion having a size and shape for engagement with said anchoring member; and a support member configured and arranged to cooperate with said latch to position said latch and said anchoring member in said housing;

said latch being mounted for movement between an unlatching position, whereby said anchoring member is received or released from said latch, and at least one latching position, whereby said anchoring member is retained by said latch in said housing;

said support member having an engagement surface and said latch having an engagement surface, said engagement surfaces being fixed relative to each other in said unlatching position of said latch and being movable relative to each other as said latch is moved from said unlatching position toward said at least one latching position.

2. A retention device according to claim 1, wherein:

said portion of said latch comprises a positioning member, said positioning member includes a retention element and a control element, said retention element and said control element being located a fixed distance apart on opposite sides of said anchoring member, said retention element retaining said anchoring member in said housing in response to forces exerted by said anchoring member in an unlatching direction, toward said unlatching position, said control element forcing said latch in a latching direction away from said unlatching position as said anchoring member is displaced in said housing in said latching direction away from said unlatching position.

3. A retention device according to claim 2, wherein:

said control element is arranged to limit displacement of said latch in said latching direction.

4. A retention device according to claim 2, wherein:

said housing is defined by structure preventing translation of said anchoring member in any direction other than said latching and unlatching directions, and said positioning member controls translation of said anchoring device only in said latching and unlatching directions.

5. A retention device according to claim 1, wherein:

said latch is mounted for rotational movement about an axis; and said support member is mounted for rotational movement about an axis distinct from said rotational axis of said latch.

6. A retention device according to claim 5, wherein:

said rotational axis of said support member is located on said retention mechanism substantially between said housing and said rotational axis of said latch.

7. A retention device according to claim 5, wherein:

said rotational axis of said support member and said rotational axis of said latch are located on a common part of said retention mechanism in proximity to the boot when said anchoring member of the boot is retained in said latching position, said rotational axis of said latch being positioned to be closer to the gliding board than said rotational axis of said support member.

8. A retention device according to claim 6, further comprising:

an elastic member positioned to exert a constant biasing force on said latch and said support member relative to each other in a direction urging contact between said engagement surfaces of said support member and said latch when said latch is in a latching position.

9. A retention device according to claim 8, wherein:

a stop structure maintains said latch and said support member in a fixed position relative to each other in said unlatching position of said latch.

10. A retention device according to claim 9, wherein:

said stop structure comprises at least one shoulder formed in one of said engagement surfaces of said support member and said latch.

11. A retention device according to claim 1, further comprising:

a base to be fixed to the gliding board, wherein said housing is fixed with respect to said base.

12. A retention device according to claim 1, in combination with said boot, said boot having no anchoring member extending from said opposite side of said boot.

13. A progressive retention device for retaining a boot on a gliding board, by binding a single side of the boot to the gliding board, said retention device comprising:

an anchoring structure adapted to be secured to the boot and including a part extending laterally from one side of the boot, said part of said anchoring structure including an anchoring member, said anchoring member extending in a longitudinal direction of the boot, the retention device including no anchoring member extending from an opposite side of the boot;

a retention mechanism adapted to be affixed to the gliding board, said retention mechanism comprising a housing adapted to be fixed with respect to the gliding board, said housing having a size and shape to receive said anchoring member in a latching position of the retention device;

said retention mechanism further comprising:

a latch including a portion having a size and shape for engagement with said anchoring member, said latch being mounted for movement between an unlatching position, whereby said anchoring member is received or released from said latch, and a range of latching positions; and a support member mounted for movement with respect to said latch, said support member having an engagement surface and said latch having an engagement surface, said engagement surfaces being fixed relative to each other in said unlatching position; and an elastic biasing member exerting a constant elastic force on said support member in a direction urging said latch away from said unlatching position toward the gliding board, whereby said engagement surface of said support member moves along said engagement surface of said latch as said anchoring member is moved within said housing toward the gliding board within said range of latching positions to firmly retain said anchoring member within said housing in said range of latching positions.

14. A retention device according to claim 13, wherein:

said engagement surface of said latch is substantially smooth, said smooth surface being engaged by said engagement surface of said support member within said range of latching positions.

15. A retention device according to claim 13, wherein:

said engagement surface of said latch has a substantially constant arc of curvature, said engagement surface of said latch being engaged by said engagement surface of said support member within said range of latching positions.

16. A retention device according to claim 13, wherein:

said portion of said latch comprises a positioning member, said positioning member includes a retention element and a control element, said retention element and said control element being located a fixed distance apart on opposite sides of said anchoring member, said retention element retaining said anchoring member in said housing in response to forces exerted by said anchoring member in an unlatching direction, toward said unlatching position, said control element forcing said latch in a latching direction away from said unlatching position as said anchoring member is displaced in said housing in said latching direction away from said unlatching position.

17. A retention device according to claim 16, wherein:

said control element is arranged to limit displacement of said latch in said latching direction.

18. A retention device according to claim 16, wherein:

said housing is defined by structure preventing translation of said anchoring member in any direction other than said latching and unlatching directions, and said positioning member controls translation of said anchoring device only in said latching and unlatching directions.

19. A retention device according to claim 13, wherein:

said latch is mounted for rotational movement about an axis; and said support member is mounted for rotational movement about an axis distinct from said rotational axis of said latch.

20. A retention device according to claim 19, wherein:

said rotational axis of said support member is located on said retention mechanism substantially between said housing and said rotational axis of said latch.

21. A retention device according to claim 19, wherein:

said rotational axis of said support member and said rotational axis of said latch are located on a common part of said retention mechanism in proximity to the boot when said anchoring member of the boot is retained in said latching position, said rotational axis of said latch being positioned to be closer to the gliding board than said rotational axis of said support member.

22. A retention device according to claim 13, wherein:

a stop structure maintains said latch and said support member in a fixed position relative to each other in said unlatching position of said latch.

23. A retention device according to claim 22, wherein:

said stop structure comprises at least one shoulder formed in one of said engagement surfaces of said support member and said latch.

24. A retention device according to claim 13, further comprising:

a base to be fixed to the gliding board, wherein said housing is fixed with respect to said base.

25. A retention device according to claim 13, in combination with said boot, said boot having no anchoring member extending from said opposite side of said boot.

* * * * *